US005713723A

United States Patent [19]

Hathaway

[11] Patent Number: 5,713,723

[45] Date of Patent: Feb. 3, 1998

[54] VOLUMETRIC HAND PUMP

[75] Inventor: John E. Hathaway, Fort Wayne, Ind.

[73] Assignee: Tuthill Corporation, Fort Wayne, Ind.

[21] Appl. No.: 780,456

[22] Filed: Jan. 8, 1997

Related U.S. Application Data

[60] Provisional application No. 60/017,448 May 17, 1996.

[51] Int. Cl.[6] ..... F01B 11/02; F01B 31/00

[52] U.S. Cl. ..... 417/63; 417/435; 417/570; 92/170.1

[58] Field of Search ..... 417/63, 313, 430, 417/570; 92/170.1, 7

[56] References Cited

U.S. PATENT DOCUMENTS

| | | | |
|---|---|---|---|
| 14,734 | 4/1856 | Palmer . | |
| 1,122,111 | 12/1914 | Hanson | 417/63 |
| 1,137,456 | 4/1915 | Bowser | 417/63 |
| 1,143,158 | 6/1915 | Young | 417/313 |
| 1,548,120 | 8/1925 | Dourson . | |
| 1,610,174 | 11/1926 | Smith et al. | 417/63 |
| 2,563,930 | 8/1951 | Hamann et al. . | |
| 2,798,647 | 7/1957 | Broadwin . | |
| 3,337,095 | 8/1967 | Marbach et al. . | |
| 3,341,078 | 9/1967 | Cardillo . | |
| 4,195,672 | 4/1980 | Freeman . | |
| 4,809,909 | 3/1989 | Kukesh . | |
| 4,925,096 | 5/1990 | Gill . | |
| 5,248,070 | 9/1993 | Nolte et al. . | |
| 5,299,606 | 4/1994 | Schrupp . | |

*Primary Examiner*—Charles G. Freay
*Attorney, Agent, or Firm*—Barnes & Thornburg

[57] ABSTRACT

A volumetric hand pump having a transparent pump chamber and a fixed full stroke volume. The transparent pump chamber allows visual observation of the amount of fluid being pumped when less than the fixed full stroke volume is used. The transparent pump chamber is surrounded by a housing or shroud which includes one or more windows that allow visual access to the transparent pump chamber. An optional stroke counter can be provided to track the number of full pump strokes, thus allowing accurate dispensing of both large and small quantities of fluids, while providing visual observation of the amount of fluid being pumped and dispensed. The pump is particularly useful for dispensing agricultural chemicals.

31 Claims, 10 Drawing Sheets

VOLUMETRIC HAND PUMP

RELATED APPLICATION

This application is a continuation-in-part of U.S. provisional application Ser. No. 60/017,448, filed May 17, 1996.

TECHNICAL FIELD

The present invention relates to volumetric hand pumps and more particularly to volumetric hand pumps which are capable of accurately dispensing both large and small quantities of fluids, while providing visual observation of the amount of fluid being pumped and dispensed.

BACKGROUND ART

Currently agricultural and industrial chemicals, including pesticides and herbicides are being regulated due to health and environmental concerns. Herbicides in particular are being manufactured with more potency and at extremely high costs. In some cases, herbicides are applied in recommended amounts of only a few ounces per acre.

It is accordingly important to be able to accurately dispense large and small amounts of agricultural chemicals in order to comply with regulations, as well as to lower costs. It is also important to dispense agricultural chemicals in a manner which avoids waste and undesirable spillage.

Heretofore, hand pumps for dispensing agricultural chemicals were used in conjunction with flow meters or volumetric flasks. The flow meters were used to determine the amount of chemicals being dispensed. This manner of dispensing agricultural chemicals has several inherent problems. For example, flow meters are not particularly accurate when used for measuring small amounts of liquids. Flow meters are also subject to variations caused when air is pumped through the lines. The use of conventional hand pumps requires initial priming of the pumps. Such priming causes air to be pumped, and uneven flow which adversely effect the accuracy of flow meters.

Volumetric flasks add another chemical handling step to the task of transferring fluids from one container to another. This increases the risk of worker exposure and contamination.

Volumetric hand pumps having clear glass housings have been proposed for use in dispensing agricultural chemicals. However, it has been determined that the use of glass components raises an unacceptable risk of spillage due to the liability of glass to break in normal field use.

The present invention provides a volumetric hand pump and system which overcomes many of the disadvantages associated with prior hand pumps.

DISCLOSURE OF THE INVENTION

It is accordingly one object of the present invention to provide a hand operated volumetric pump.

Another object of the present invention is to provide a hand operated volumetric pump which is capable of accurately dispensing both large and small volumes of fluids.

It is another object of the present invention to provide a hand operated volumetric pump which provides for visual observation of pumped fluid amounts.

A further object of the present invention is to provide a hand operated volumetric pump which pumps a set fluid volume for each full pump stroke.

It is a further object of the present invention to provide a hand operated volumetric pump which is suitable for rough field use.

It is a further object of the present invention to provide a hand operated pump which is resistant to agricultural chemicals.

A still further object of the present invention is to provide a hand operated volumetric pump which does not leak fluids between pumping strokes.

A still further object of the present invention is to provide a hand operated pump which can be easily primed and which does not loose its prime.

According to these and further objects of the present invention which will become apparent as the description thereof proceeds below, the present invention provides a volumetric pump which includes:

- a transparent chamber;
- a piston disposed in the transparent chamber for reciprocal movement therein; and
- an integral shroud which surrounds the transparent chamber and includes at least one window for viewing a pumped fluid level in the transparent chamber.

BRIEF DESCRIPTION OF DRAWINGS

The present invention will be described hereafter with reference to the attached drawings which are given as non-limiting examples only, in which.

BEST MODE FOR CARRYING OUT THE INVENTION

The volumetric pumps of the present invention provide a visible pumping chamber with a graduate scale which allows accurate pumping and dispensing of fluids. The pump further is designed to accurately pump and dispense a fixed volume of fluid, e.g. a quart, liter, gallon, etc., during a complete stroke of the piston. Therefore, with an optional stroke counter included, large quantities of fluids can be quickly pumped and dispensed together with smaller quantities of fluids, e.g. ounces or milliliters, which can be visually determined and effected by appropriately limiting the piston stroke. According to one embodiment of the present invention, the accuracy of a full stroke volume of a one quart pump was consistently found to be one-sixth of an ounce (or 5 milliliters).

The volumetric pumps of the present invention include a threaded connector at the inlet in the base thereof which can be suitably adapted for connection to barrels, storage tanks, drums, and the like. Other means to connect the pump to a source of fluid to be dispensed include NPT threaded bung adapters, buttress threaded bung adapters, bayonet connectors, or the like.

The volumetric pumps are self-priming and can be utilized in conjunction with a telescopic suction design and/or quick disconnect couplings that can include water brakes.

The volumetric pumps of the present invention are preferably made from materials which are inert to agricultural chemicals, particularly pesticides and more particularly herbicides. It is to be understood that the materials from which the pumps are made can be selected so as to be inert for any particular dispensing purpose.

In addition to being inert, the pumps are preferably made from materials which are resistant to breakage during rough service. For example, the pump housings are produced from a molded, reinforced thermoplastic material such as glass-filled polypropylene. The pump chambers are preferably made from Barex® resin (available from BP, Warrensville, Ohio). This material has been found to be particularly useful for purposes of the present invention. Because the pumps of the present invention include a shroud which surrounds and protects the pump chambers, it is possible to make the pump chambers out of glass. However, materials which are resistant to breakage are preferred for rough field use. Field use includes hauling or transporting and using the pumps on farms, ranches, forest areas, parks and other similar environments.

Figure 1:
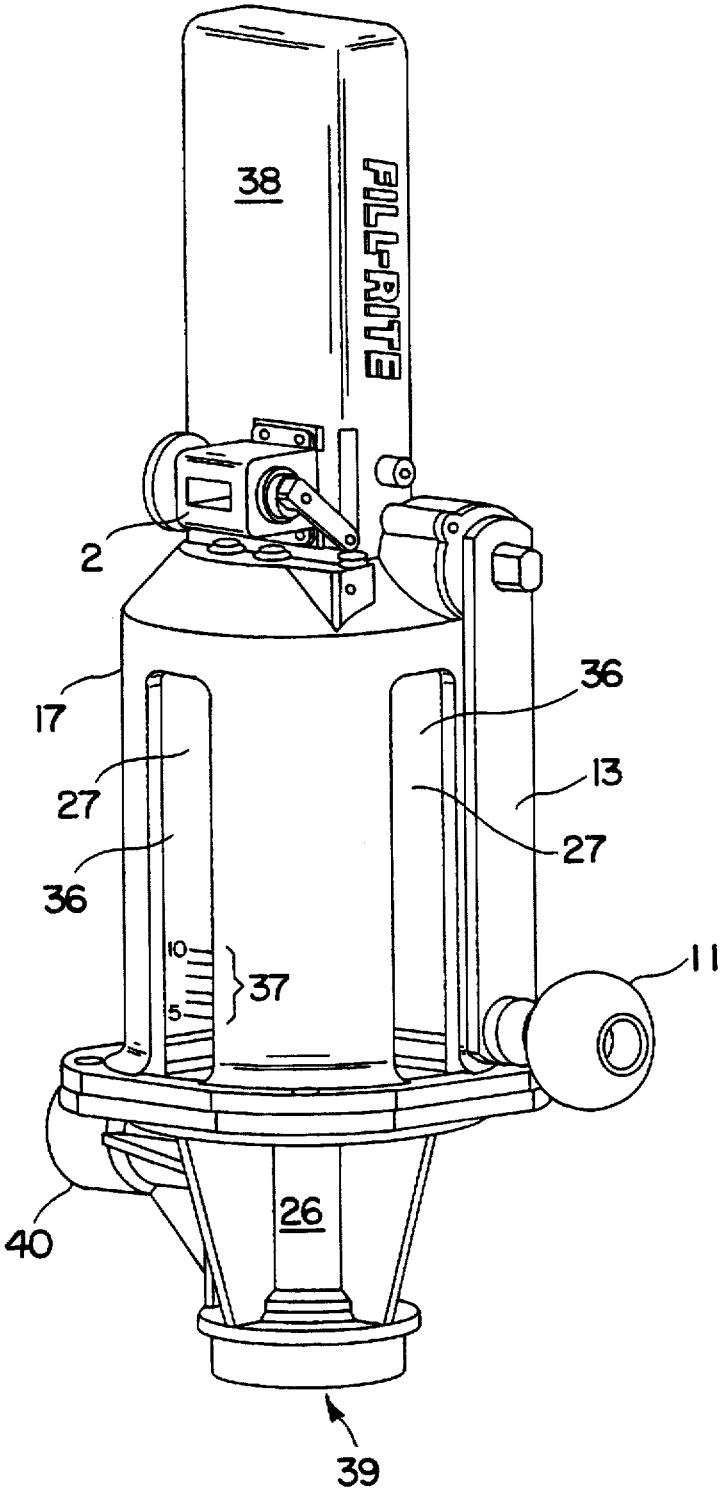
FIG. 1 is a perspective view of a volumetric hand pump according to one embodiment of the present invention.

FIG. 1 is perspective view of a volumetric hand pump according to one embodiment of the present invention. As shown in FIG. 1 the pump includes a housing or shroud 17, having one or more windows 36 provided therein. The windows 36 allow visual access to a pump chamber 27 which is defined by a transparent tube. Pump chamber or transparent tube 27 is preferably cylindrical. However, the pump chamber or transparent tube 27 may have a non-circular cross-section. As depicted in FIG. 1, pump chamber or transparent tube 27 can include a graduate scale 37 at one or more locations which is visible through one or more of the windows 36. The graduate scale 37 provides a reference by which to observe the fluid level that is drawn into pump chamber or transparent tube 27 by piston 31 (see FIG. 2). In an alternative embodiment, a similar graduate scale could be provided on the pump housing or shroud 17 adjacent one or more of windows 36.

Figure 2:
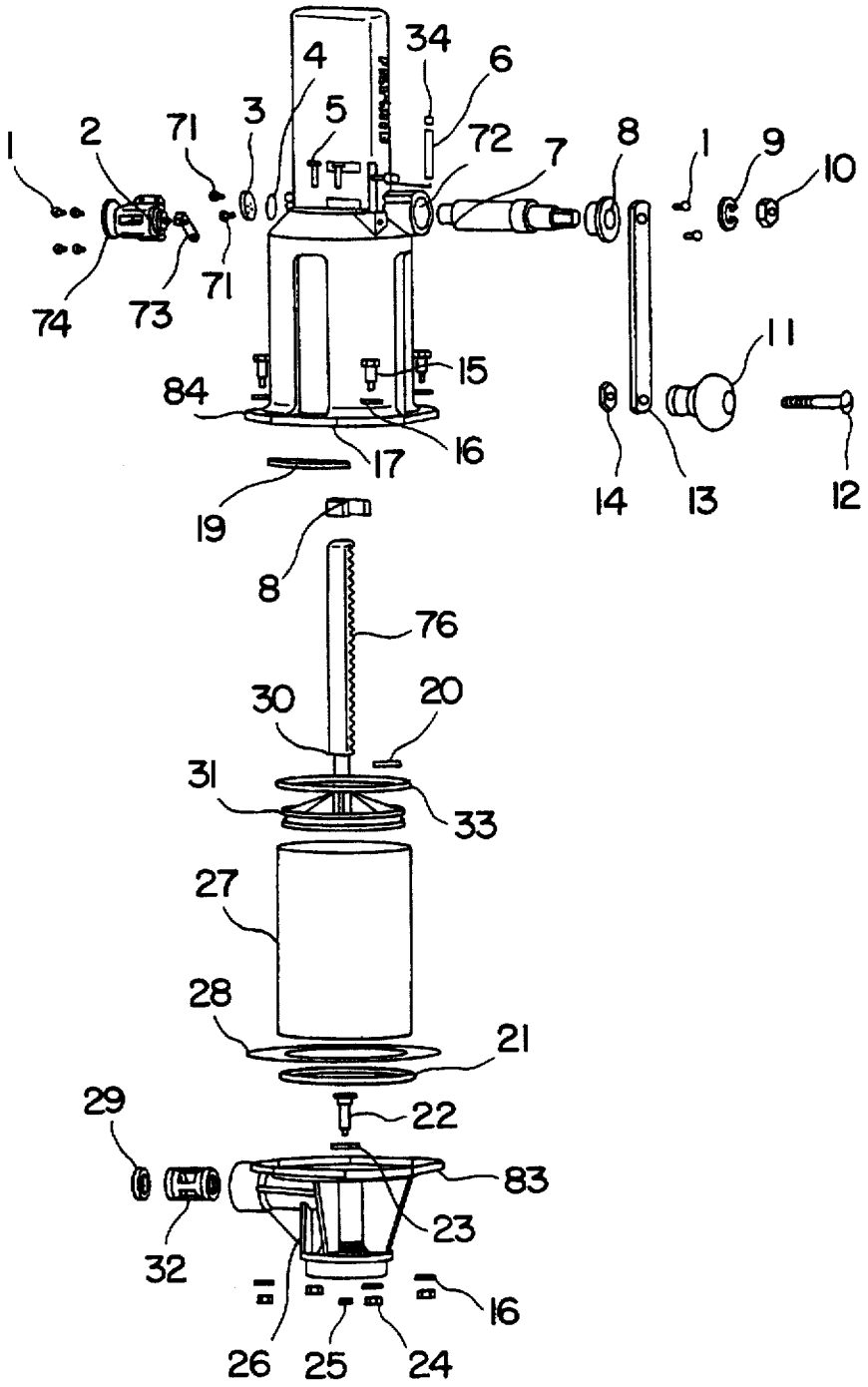
FIG. 2 is an exploded view of the volumetric hand pump of FIG. 1.

The pump housing or shroud 17 is preferably an integral structure which can be made according to any convenient manner such as molding and/or machining. As discussed below, the shroud 17 includes a handle portion 38 which houses the mechanism that actuates piston 31. The pump housing or shroud 17 both protects the pump chamber or tube 27 from being broken, scratched or jarred out of alignment, and protects the mechanism that activates the piston 31 from being exposed to the environment or otherwise being damaged. In order to protect the pump chamber or transparent tube 27, the windows should be small enough to prevent objects from contacting the pump chamber or transparent tube 27, and large enough to allow viewing of fluids contained therein. In one embodiment of the present invention a vent port 70 is provided in the shroud 17 at a location which provides fluid communication between the top of piston 31 and the ambient atmosphere. Such venting helps equalize fluid pressures above the piston 31, particularly when the portion of the pump housing or shroud 17 above the piston 31 is otherwise fluid tight. In order to prevent dirt and dust from entering the pump housing or shroud 17, a filter 4 element can be provided across the vent port 70 and secured in position by a vent cap 3 (FIG. 2). Vent cap 3 is preferably removable so that filter 4 can be removed and/or replaced whenever it becomes obstructed. In this regard, vent port 70 and vent cap 3 may have complementary threads by which vent cap 3 can be connected to vent port 70. In a preferred embodiment, vent cap 3 can be secured over vent port 70 by mechanical fasteners, e.g., screws 71. In a further embodiment of the invention, filter 4 may be a semipermeable membrane which prevents moisture from entering the upper portion of shroud 17. Such semipermeable membrane materials are well known.

The pump chamber or transparent tube 27 is sized to pump a set volume of fluid, e.g. a pint, quart, liter, gallon, etc. during a complete stroke of the piston 31. The graduate scale 37 is appropriately marked in volumes, such as ounces, milliliters, etc. Alternatively, the graduate scale 37 can be marked to indicate an area of application, such as acres. It is also within the scope of the present invention to include multiple graduate scales, e.g. different volume increments and/or areas of application. Such multiple graduate scales could be provided on or adjacent the same or different portions of the pump chamber or transparent tube 27 which is visible thorough any given window 36.

During the course of the present invention, a number of transparent materials were considered for use in making the pump chamber or transparent tube 27. Initially glass was considered as a possible material despite concerns that glass could easily break during field use and create a hazardous situation. It was determined that the shroud 17 could adequately protect a glass tube from being contacted by most objects, particularly if the width and number of windows were limited. However, in an attempt to find a more durable material from which to manufacture pump chamber or transparent tube 27, a number of plastic materials were considered.

The pump housing or shroud 17 provides structural support for thin walled transparent tubes. The pump housing or shroud 17 closely surrounds the pump chamber or transparent tube 27, and can be of any convenient thickness which structurally supports the pump chamber or transparent tube 27 from becoming deflected from vacuums and pressures which are created by movement of piston 31. This allows the transparent tube 27 to be sufficiently thin for purposes of being transparent. Because the pump housing or shroud 27 closely surrounds the outer periphery of the pump chamber or transparent tube 27, it tends to resist any outward and non-symmetrical inward deflection the pump chamber or transparent tube 27 may undergo by restricting all outward deformation of the pump chamber or transparent tube 27.

The pump chamber or transparent tube 27 is preferably made from a thermoplastic material such as a polypropylene, polyester, etc. A particularly preferred material from which to make the transparent tube is Barex®

Resin (available from BP, Warrensville, Ohio). The pump chamber or transparent tube 27 has a wall thickness which is thin enough to be sufficiently transparent, yet preferably thick enough to resist deformation due to vacuum and pressure forces which occur during pumping. For example, according to one embodiment of the present invention, tubes made of Barex® (a relatively stiff material) had a wall thickness of about 0.050 and were found to be suitable for purposes of the present invention. Tubes made of polypropylene (a relatively flexible material) having a wall thickness of 0.030 where found not to be suitable due to excessive wall deflection. Suitable wall thicknesses for other materials can be easily determined based upon the transparency of the material used to make the pump chamber or transparent tube 27. The thickness of the transparent tube 27 is selected to allow visible observation of the liquid level in the pump chamber. Accordingly, it is possible to use a semi-transparent or translucent tube when the fluid being pumped is colored or dyed, because a colored or dyed fluid is easier to see than a clear liquid. Transparent tubes allow for the use of thicker tube walls than other, less transparent materials.

As mentioned above, the pump housing or shroud 17 includes an upper molded handle portion 38 which houses the mechanism which effects reciprocal movement of piston 31 within pump chamber or transparent tube 27. In a preferred embodiment which is illustrated in FIG. 2, the mechanism which effects reciprocal motion of piston 31 includes a rack 30 and pinion 7. In this embodiment, the upper molded handle portion 38 of shroud 17 houses rack 30 (see FIG. 2) when the piston 31 is at its upper most position. Pinion 7 is received in bore 72 of pump housing or shroud 17, and is secured therein by bushing 8 which is attached to pump housing or shroud 17 by suitable mechanical means such as screws 1. Crank handle 13 is attached to pinion 7 by a lock washer 9 and threaded nut 10, or other suitable means. Threaded nut 10 is received on a threaded end of pinion 7 as depicted in FIG. 2. Crank handle 13 includes a knob 11 which is attached on a free end thereof by a suitable mechanical means such as screw 12 and threaded nut 14.

The upper handle portion 38 of the pump housing or shroud 17 functions as a handle in that it can be grasped when the operator utilizes his or her other hand to rotate crank handle 13. In order to facilitate this "handle" function, the upper handle portion 38 of pump housing or shroud 17 can be configured to include any convenient handle structure, including a gripping structure.

An optional stroke counter 2 can be attached to pump housing or shroud 17 and activated by a suitable linkage which is pushed upward when contacted by piston 31, rack 30 or some protrusion formed thereon. Stroke counter shaft 6 is inserted in a bore which is provided in pump housing or shroud 17 adjacent upper handle portion 38 so that stroke counter shaft 6 can be pushed upward each time piston 31 is moved upward. As depicted in FIG. 2, an activator shaft head 34 is provided on stroke counter shaft 6 and prevents stroke counter shaft 6 from dropping into pump housing or shroud 17. Activator shaft head 34 contacts the arm of stroke counter 2 and moves arm 73 of stroke counter upward as piston 31 engages and moves stroke counter shaft upward. Stroke counter 2 can be secured to upper portion 38 of the pump housing or shroud 17 by suitable mechanical fasteners 1 such as screws 1. The relative positions of the stroke counter 2 and stroke counter shaft 6 can be seen in FIG. 1.

The inlet 39 for the pump is provided on the bottom thereof, and can include internal and/or external threads for connection thereto with a suction feed pipe and a connection on a tank, drum, barrel, etc. The outlet 40 of the pump is also located near the bottom as depicted in FIG. 1 and can include any convenient structure for connecting a hose thereto.

FIG. 2 is an exploded view of the volumetric hand pump of FIG. 1, which shows the internal and external parts thereof. Table 1, attached hereto, identifies the elements which are labeled in FIG. 2

As depicted in FIG. 2 the pump includes pump chamber or transparent tube 27 which is contained in pump housing or shroud 17. Within transparent tube 27, there is a piston 31 having a piston gasket, e.g. o-ring 33 on an outer periphery thereof. The piston 31 is attached to an end of rack 30 by a suitable means such as spring pin 20. Rack 30 extends through an upper handle portion 38 of the pump housing or shroud 17 which includes bore 72 that receives pinion 7. Pinion 7 includes teeth 75 which cooperate with corresponding teeth 76 on rack 30 to drive rack 30 in a known manner.

A volumetric, e.g. quart or liter insert 18 is provided on the top of rack 30, and serves as a stop which limits the upward travel of the rack 30, so that a fixed volume of fluid is pumped during each full stroke of the pump. The upward movement of rack 30 stops when volumetric insert 18 contacts an upper inner surface of pump housing or shroud 17. Also shown in FIG. 2 is a rack guide 19 which maintains alignment of the rack 30 with respect to the upper handle portion 38 of pump housing or shroud 17.

The pump housing or shroud 17 is attached to pump base 26 by suitable mechanical means such as bolts 15 and corresponding flat washers 16 and lock nuts The pump inlet 39 and outlet 40 are each provided with one-way check valves 22 and 32. The inlet check valve 22, as discussed in more detail below is substantially flush with the bottom of the pump chamber so as to limit dead space of the valve. The outlet valve 32 is secured in outlet opening by means of valve retainer 29.

Figure 3:
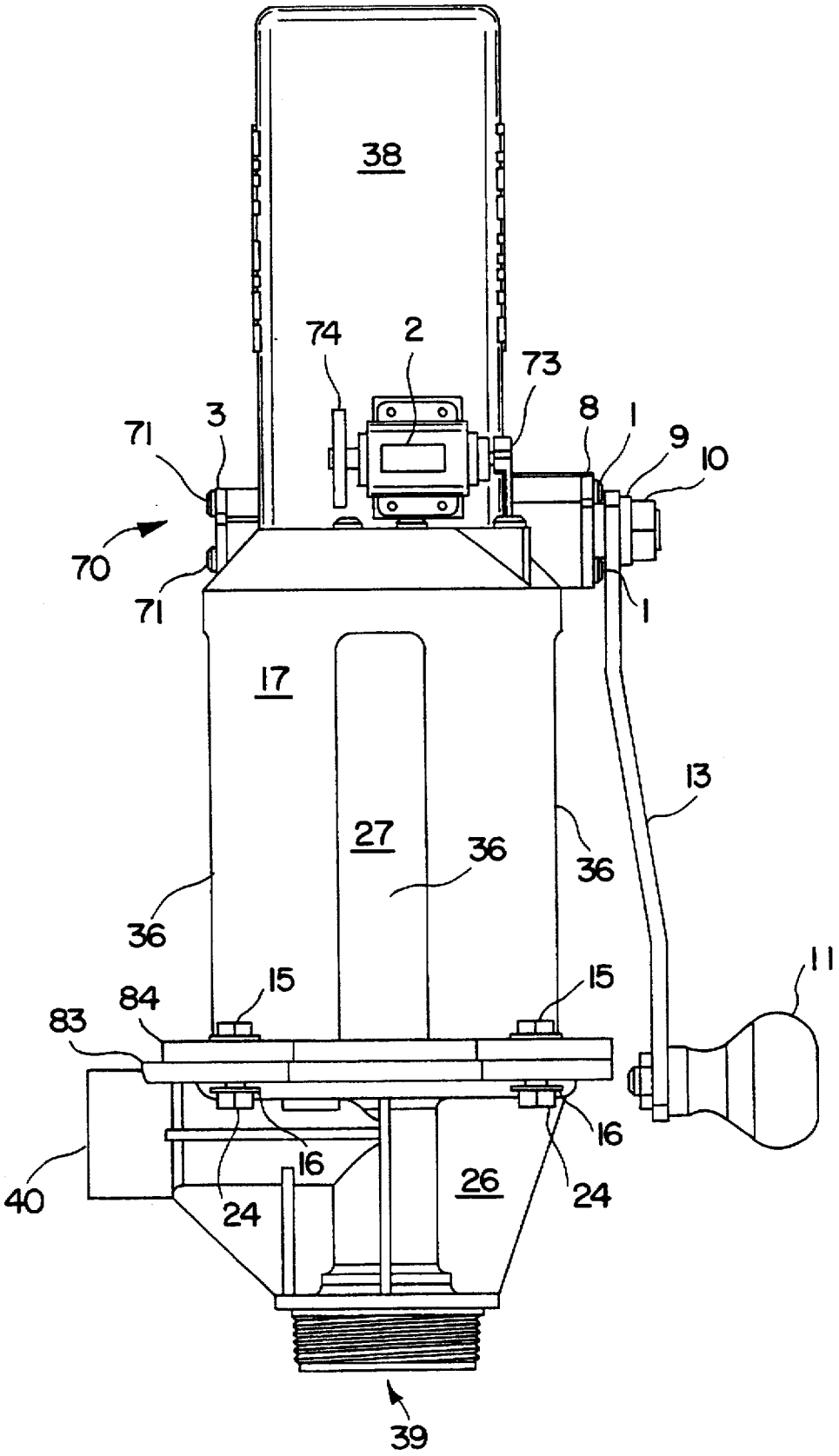
FIG. 3 is a front elevational view of the volumetric pump of FIG. 1.

FIG. 3 is a front elevational view of the volumetric pump of FIG. 1. FIG. 3 depicts the manner in which the housing or shroud 17 is secured to pump base 26 by bolts 15 which connect the respective flanges 83 and 84 of the pump base 26 and housing or shroud 17 together. In FIG. 3, the optional stroke counter 2 is depicted as being attached to the upper handle portion 38 so as to face toward the front of the pump. The pump depicted in FIG. 3 is designed for right-handed persons. In this regard the upper handle portion 38 of the pump housing or shroud 17 can be gripped by the operator's left hand and crank handle knob 11 can be rotated by the operator's right hand. A left-hand operated pump can be provided by positioning the crank handle 13 on the opposite side of the pump housing or shroud 17.

Figure 4:
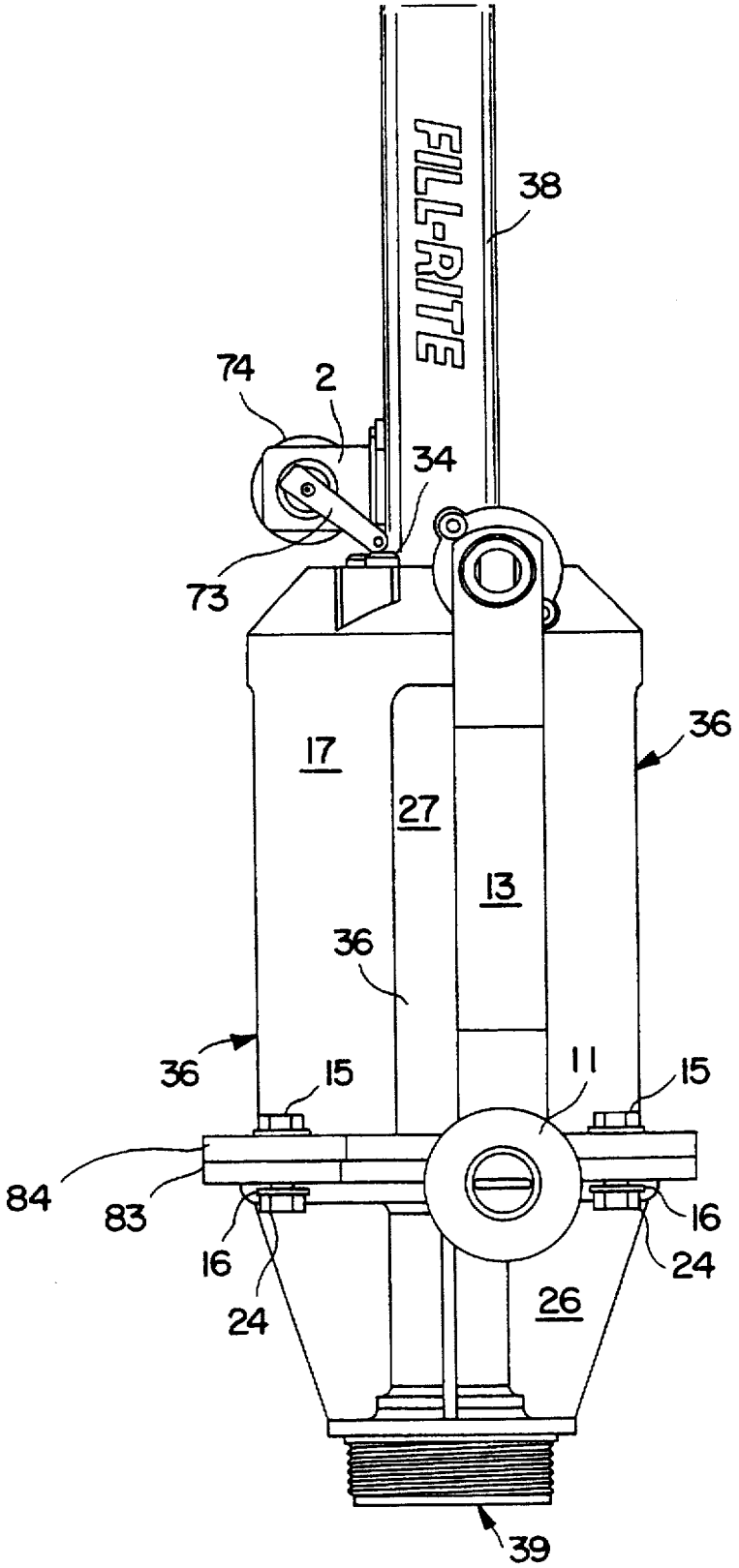
FIG. 4 is a side elevational view of the volumetric pump of FIG. 1 facing the pump handle.

FIG. 4 is a side elevational view of the volumetric pump of FIG. 1 facing the pump handle. In FIG. 4 the arm 73 of stroke counter 2 is shown in its downward position against activator shaft head 34. When the piston 31 moves upward in pump chamber or tube 27, the top of the piston 31 contacts stroke counter shaft 6 and pushes stroke counter shaft 6 upward. Upward movement of stroke counter shaft 6 and activator shaft head 34 rotates arm 73 of the stroke counter 2 in a counter-clockwise direction as depicted in FIG. 4, thus advancing the stroke counter indexer in a known manner. FIG. 4 also depicts the bushing 8 which secures pinion 7 in bore 72, and the lock washer 9 and nut 10 which secure crank handle 13 to pinion 7.

Figure 5:
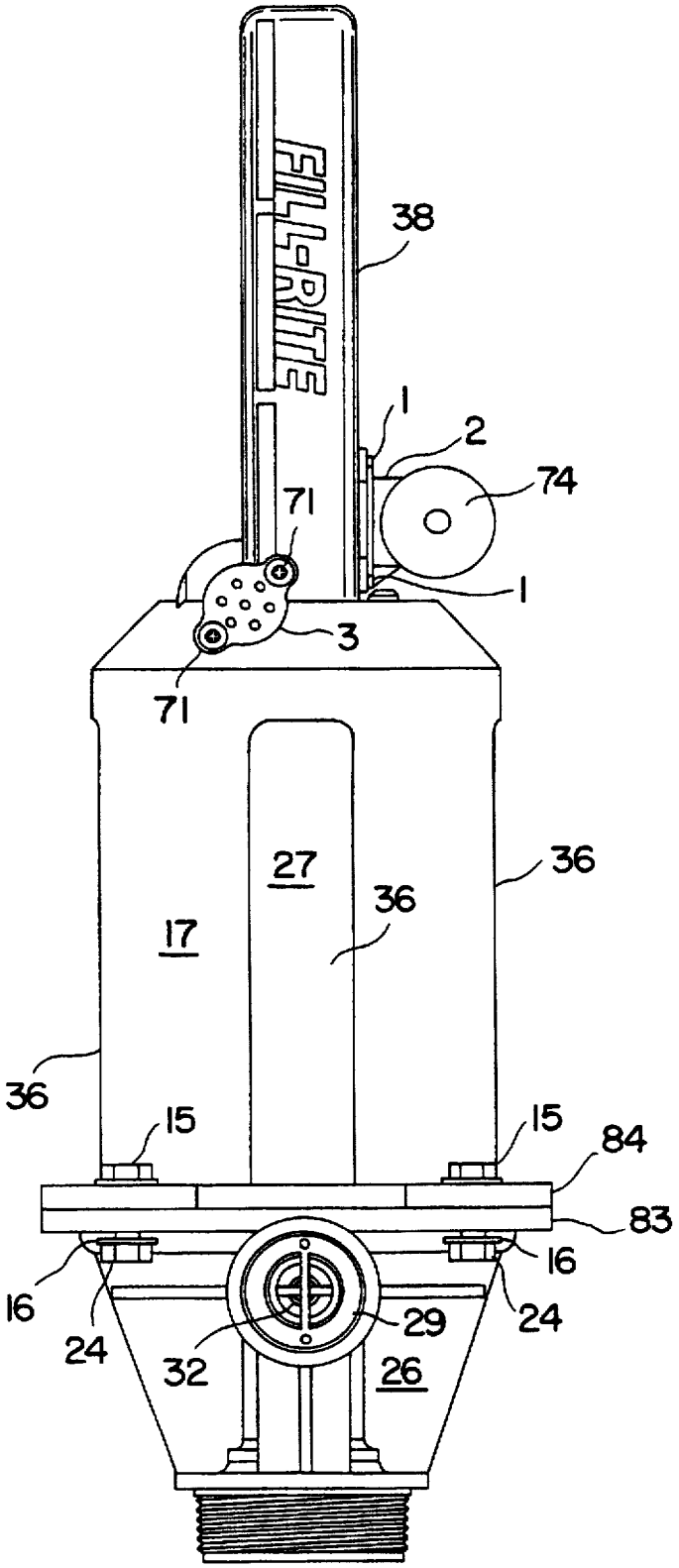
FIG. 5 is a side elevational view of the volumetric pump of FIG. 1 facing the pump outlet.

FIG. 5 is a side elevational view of the volumetric pump of FIG. 1 facing the pump outlet. FIG. 5 depicts the location of vent cap 3 which is secured to vent port 70 by screws 71. Also depicted in FIG. 5 is check valve retainer 29 which secures outlet check valve 32 in outlet 40.

Figure 6:
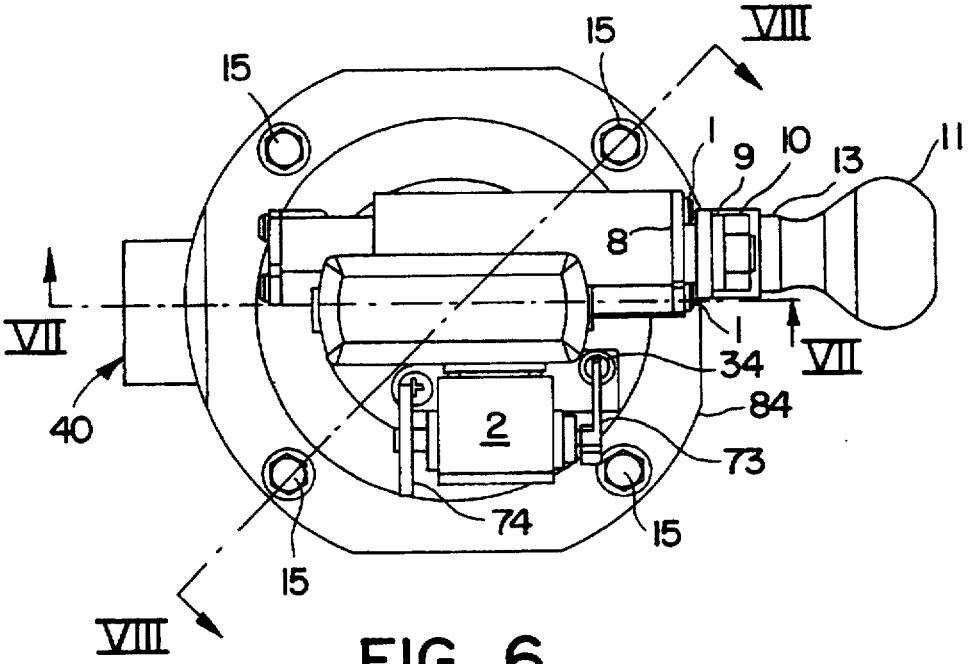
FIG. 6 is a top planar view of the volumetric pump of FIG. 1

FIG. 6 is a top planar view of the volumetric pump of FIG. 1. In the embodiment of the invention depicted in FIG. 6, the vent port 70 extends from the portion of the housing that defines bore 72 which receives pinion 7. The alignment of arm 73 of stroke counter 2 and activator shaft head 34 can be seen in FIG. 6. Also shown in FIG. 6 is a reset dial 74 for stroke counter 2. The stroke counter 2 can be either an ascending or a descending counter.

Figure 7:
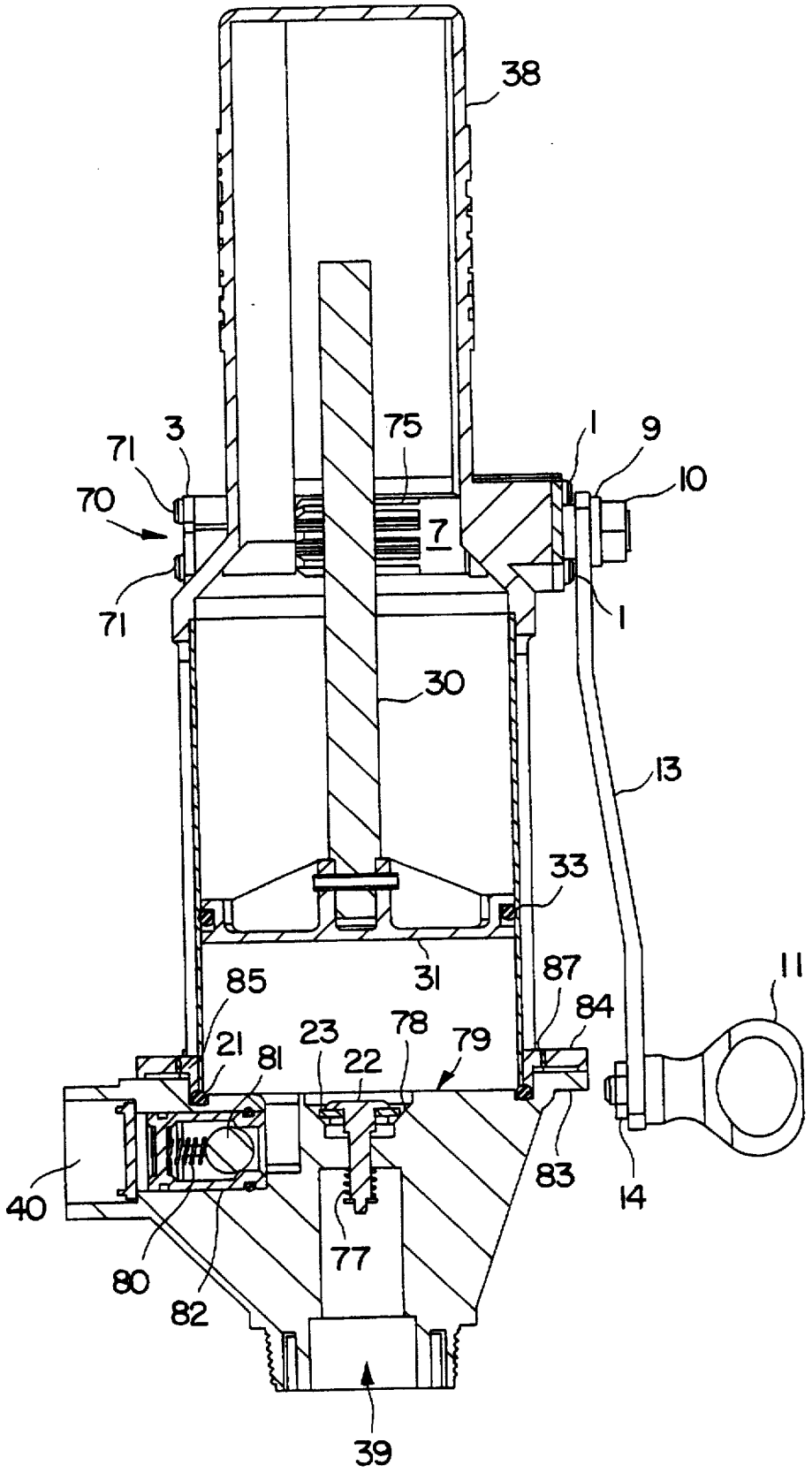
FIG. 7 is a sectional view of the volumetric pump taken along plane VII—VII of FIG. 6.

FIG. 7 is a sectional view of the volumetric pump taken along plane VII—VII of FIG. 6. As seen, teeth 75 of pinion 7 align with corresponding teeth 76 in rack 30 (FIG. 7), whereby rotation of pinion 7 via crank handle 13, causes rack 30 (and piston 31 connected thereto) to move vertically in pump chamber or tube 27. Inlet valve 22 is depicted as including a biasing spring 77 and a gasket 23 which seals against inlet valve seat 78. For purposes of the present invention it was determined that a fluorocarbon gasket was suitably chemical resistant to agricultural chemicals. As shown, the inlet valve 22 is substantially flush with the bottom 79 of the pump chamber 27 so as to eliminate or minimize dead space. In this regard, the inlet valve shown can be a poppet valve or similar valve that has a substantially flat head.

The outlet valve 32 can be the same type of valve as the inlet valve 22 or different. The outlet valve 32 depicted in FIG. 7 is a ball-type valve which is secured in outlet 40 by retainer 29, and includes a spring biasing means 80 which urges ball 81 against valve seat 82.

Figure 8:
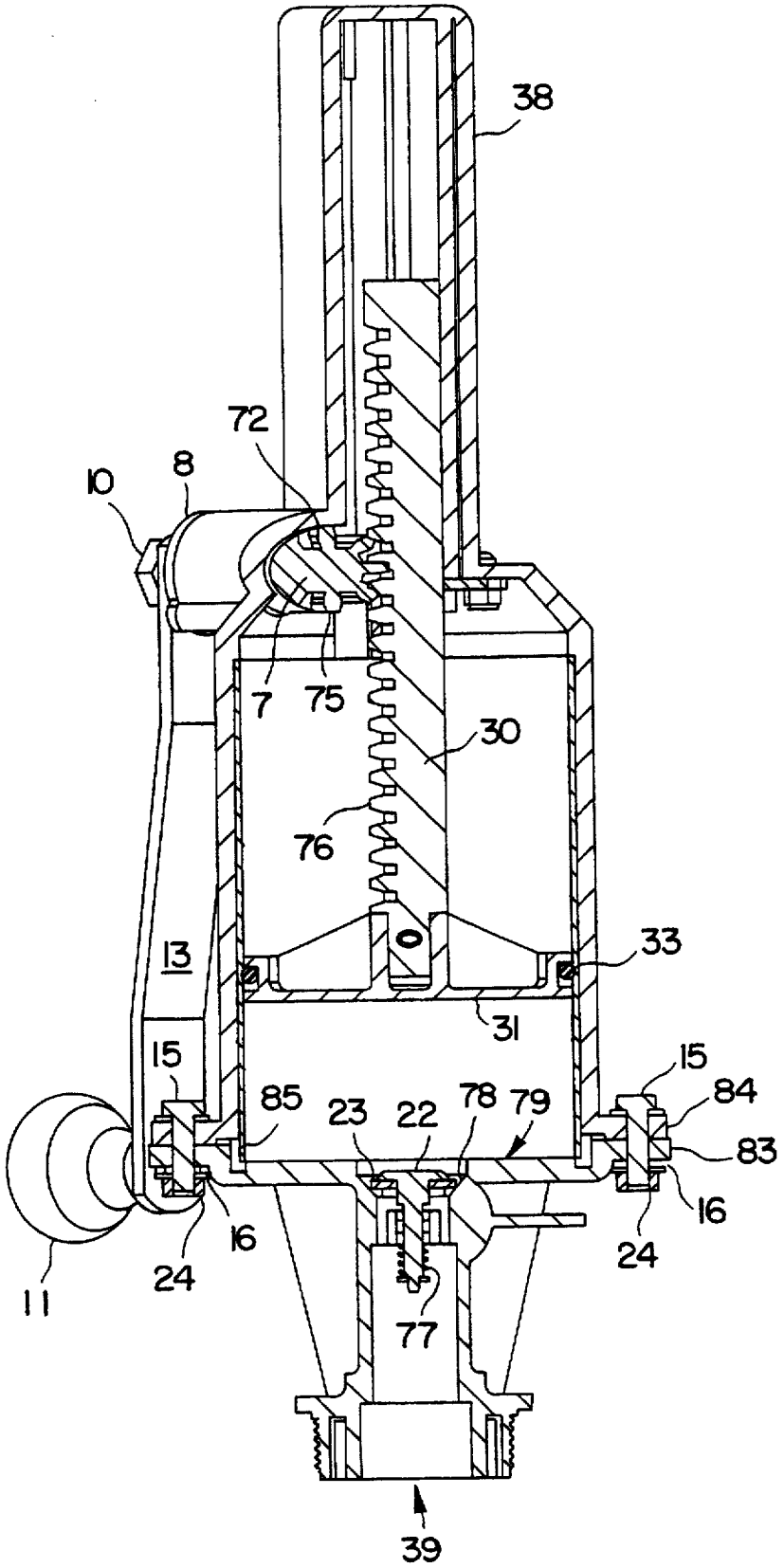
FIG. 8 is a sectional view of the volumetric pump taken along plane VIII—VIII of FIG. 6.

FIG. 8 is a sectional view of the volumetric pump taken along plane VIII—VIII of FIG. 6. FIG. 8 depicts the alignment of rack 30 and pinion 7, and how teeth 75 of pinion 7 mesh with teeth 76 of rack 30. FIG. 8 also depicts how pump base 26 is secured to housing or shroud 17 by bolts 15 which connect the respective flanges 83 and 84 of the pump base 26 together.

The embodiment of the pump depicted in FIG. 2 includes a relatively flat spacer plate 28 and an o-ring 21 which seals the bottom of the pump chamber or tube 27 to the pump base 26. The spacer plate 28 distributes the force of the pump chamber or tube 27 onto o-ring 21.

Figure 9:
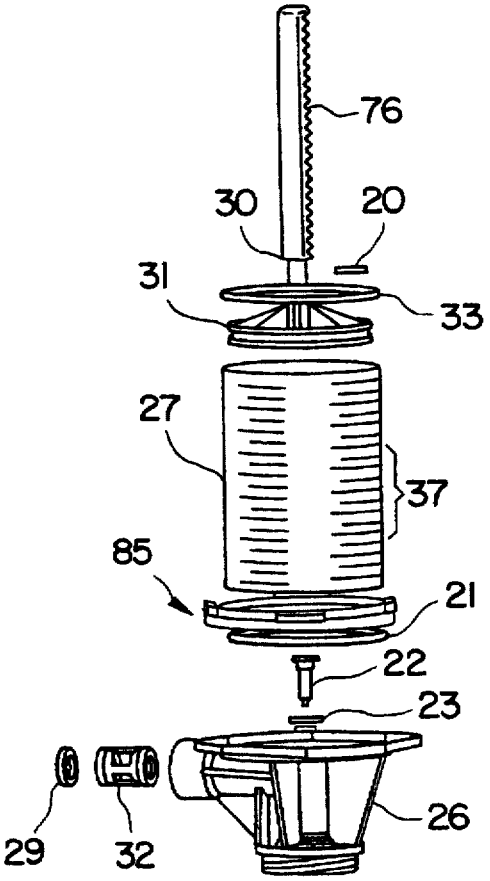
FIG. 9 is an exploded view of an alternative manner of sealing the bottom of the pump chamber or transparent tube to the pump base.

FIG. 9 is an exploded view of an alternative embodiment used to seat the bottom of the pump chamber or transparent tube to the pump base. This embodiment includes a ring spacer 85 which is provided between pump chamber or transparent tube 27 and base 26 so as to compress base o-ring 21 against base 26.

Figure 12:
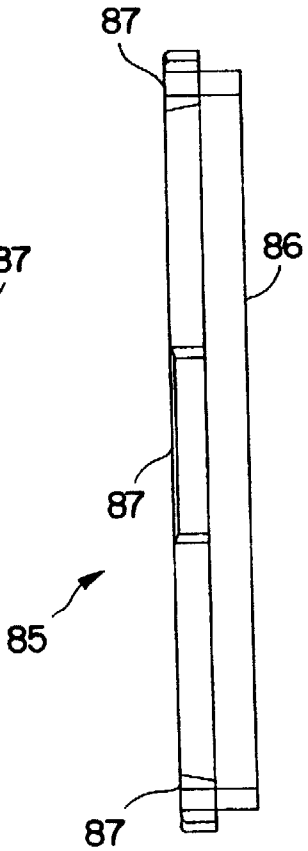
FIG. 12 is a side view of the ring spacer of FIG. 9.
Figure 11:
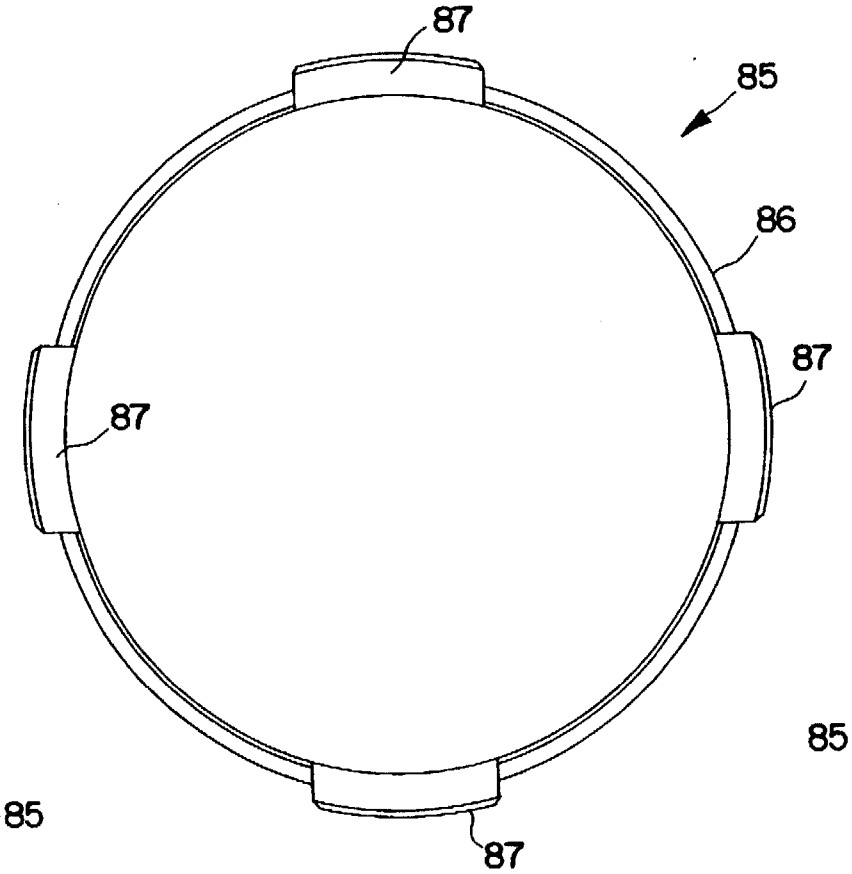
FIG. 11 is a top view of the ring spacer of FIG. 9.
Figure 10:
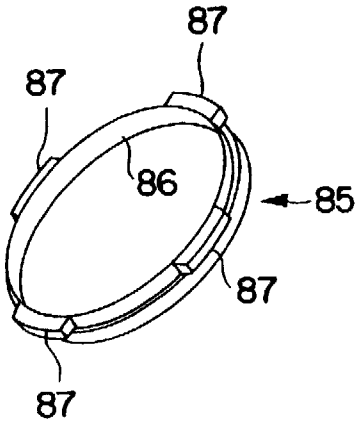
FIG. 10 is a perspective view of the ring spacer of FIG. 9.

FIG. 10 is a perspective view of the ring spacer of FIG. 9. FIG. 11 is a top view of the ring spacer of FIG. 9. FIG. 12 is a side view of the ring spacer of FIG. 9. As seen collectively from FIGS. 10–12, ring spacer 85 includes an annular ring portion 86 and a plurality of discrete flange portions 87 which extend outwardly from the upper edge of the annular ring portion 86. As depicted in FIG. 7, the discrete flange portions 87 of the ring spacer 85 extend through the windows 36 of the pump housing or shroud 17 when the pump is assembled and have a thickness which is approximately equal to that of flange 84 of the pump housing or shroud 17.

Figure 13A:
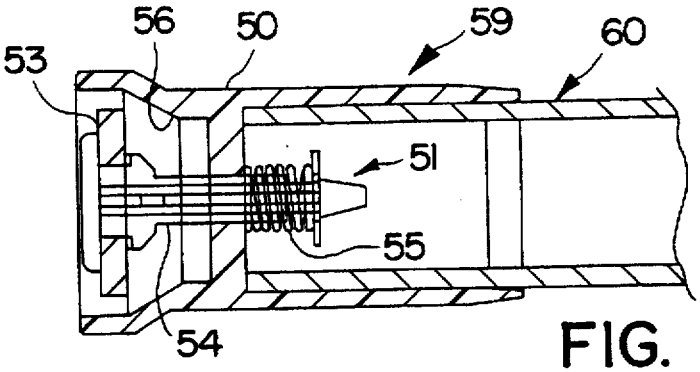
FIG. 13*a* is a cross-sectional view of an anti-drip spout according to one embodiment of the present invention which depicts the anti-drip spout in its open position.

FIG. 13*a* is a cross-sectional view of an anti-drip spout according to one embodiment of the present invention which depicts the anti-drip spout in its open position. The anti-drip spout 59 includes a body 50 which is preferably cylindrical and a spring-biased, one-way check valve 51. In use, fluid pressure acting on a upstream side 52 of the anti-drip spout 59 presses against the valve seal 53, causing the valve stem 54 to pull against spring 55 and open the one-way check valve 51.

Figure 13B:
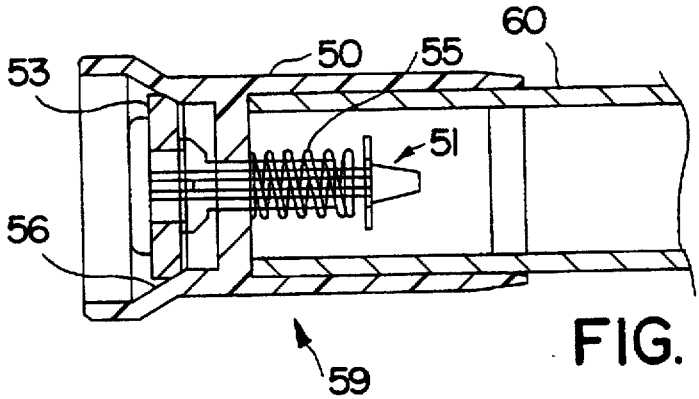
FIG. 13*b* is a cross-sectional view of the anti-drip spout of FIG. 13*a* which depicts the anti-drip spout in its closed position.

FIG. 13*b* is a cross-sectional view of the anti-drip spout of FIG. 13*a* which depicts the anti-drip spout in its closed position. In FIG. 13*b*, the valve seal 53, which is preferably made from resilient material, is pulled by spring 55 so as to contact valve seat 56.

In use, the anti-drip spout 59 is attached to the end of a nozzle 60. Such attachment can be effected by the use of a mechanical means such as a threaded connection, a snap-fit connection, etc. In a preferred embodiment, the anti-drip spout 59 is simply slid or pressed on the end of a nozzle 60 as shown in FIGS. 13*a* and 13*b*.

Figure 14:
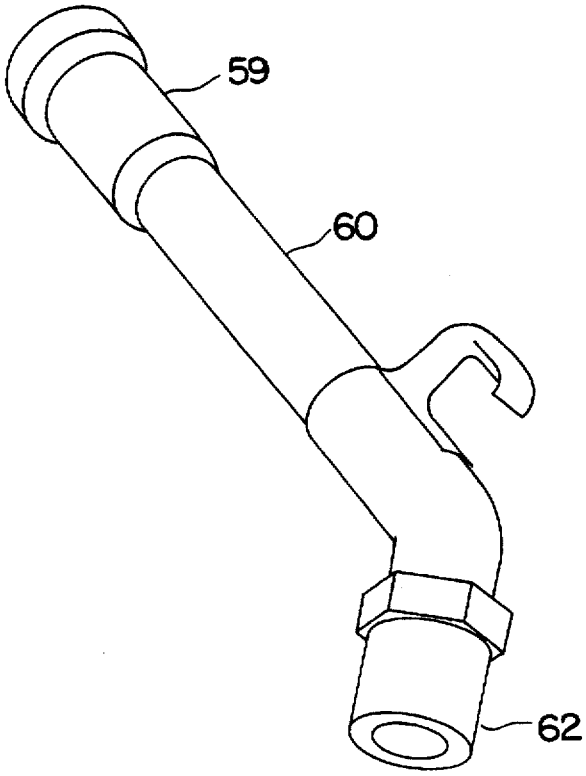
FIG. 14 is a perspective view of the anti-drip spout attached to a dispensing nozzle.

FIG. 14 is a perspective view of the anti-drip spout attached to a dispensing nozzle. In FIG. 14, the anti-drip spout 59 is depicted as being attached to, e.g., pressed onto, the dispensing end 61 of nozzle 60. End 62 of nozzle 60 is connected to a valve at the end of a dispensing hose (not shown) which in turn is connected to the outlet 40 of the volumetric pump.

In use the volumetric pump of the present invention is positioned so that a suction pipe connected to inlet 39 is submersed in a fluid to be pumped. In addition, a dispensing hose is connected between outlet 40 and a nozzle 60 having the anti-drip spout 59 attached thereto. The crank handle 13 of the pump is rotated so that piston 30 draws fluid into the pump chamber or tube 27 through inlet 39 and one-way check valve 22. As the piston 30 moves upward, stroke counter 2 registers the number of strokes the piston 30 makes. As the piston 30 moves downward fluid collected in the pump chamber or tube 27 is forced out through one-way valve 32 and outlet 40.

Initially, the pump chamber or tube 27 will contain air. Generally one or two strokes of the piston 30 are needed to clear the air from the pump chamber. More strokes of the pump will be needed to clear the air from the dispensing hose (not shown) and nozzle 60 and to prime these elements. Air is removed from the dispensing hose and nozzle 60 by holding the nozzle 60 above the pump and allowing any trapped air to rise and move toward the anti-drip spout 59. Trapped air is removed by carefully discharging the pump while holding the nozzle 60 and anti-drip spout 59 above the pump and visually watching the air escape from the anti-drip spout 59. Once all the air escapes from the anti-drip spout 59, the complete system, including the pump, dispensing hose, and nozzle 60 will be primed for use. The anti-drip spout 59 prevents spillage of dispensed fluids and loss of system prime, thus ensuring accurate pumped volumes. In order to assist in purging the system of air during priming, it is helpful to utilize a transparent dispensing hose. It is to be understood that the volumetric pump of the present invention is not limited for use in conjunction with the anti-drip spout.

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention.

What is claimed:

1. A volumetric pump which comprises:

a transparent chamber;

a piston disposed in said transparent chamber for reciprocal movement therein; and an integral shroud which surrounds said transparent chamber and includes at least one window for viewing a pumped fluid level in said transparent chamber.

2. A volumetric pump according to claim 1, wherein said integral shroud is sufficiently rigid to prevent said transparent chamber from becoming deformed during reciprocal movement of said piston.

3. A volumetric pump according to claim 2, wherein said transparent chamber is made from a material which is chemically resistant to herbicides.

4. A volumetric pump according to claim 1, wherein said transparent chamber is made from a shatter-resistant material.

5. A volumetric pump according to claim 1, wherein said transparent chamber includes indicia aligned with said at least one window so as to be visible therethrough, said indicia corresponding to an amount of liquid being pumped or an area of land to which a pumped liquid is to be applied.

6. A volumetric pump according to claim 1, further comprising a handle structure formed in an upper portion of said integral shroud.

7. A volumetric pump according to claim 1, further comprising a mechanism for reciprocally moving said piston in said transparent chamber.

8. A volumetric pump according to claim 7, wherein said mechanism comprises a rack and pinion mechanism.

9. A volumetric pump according to claim 7, wherein said mechanism is housed within a housing which extends above said integral shroud.

10. A volumetric pump according to claim 9, wherein said housing comprises a handle.

11. A volumetric pump according to claim 8, wherein said mechanism is housed within a housing which extends above said integral shroud.

12. A volumetric pump according to claim 11, wherein said housing comprises a handle.

13. A volumetric pump according to claim 12, wherein said housing is integral with said integral shroud.

14. A volumetric pump according to claim 9, wherein said piston provides a fluid-tight seal between said transparent chamber and said mechanism.

15. A volumetric pump according to claim 11, wherein said piston provides a fluid-tight seal between said transparent chamber and said mechanism.

16. A volumetric pump according to claim 1, further comprising a base having and inlet valve and an outlet valve.

17. A volumetric pump according to claim 16, wherein said base includes a substantially flat surface within said transparent chamber, which surface is flush with said piston when said piston is moved toward said surface, and wherein said inlet valve is positioned in and substantially flush with said substantially flat surface to reduce dead space in said pump.

18. A volumetric pump according to claim 16, wherein the inlet valve comprises a positive seal valve.

19. A volumetric pump according to claim 16, wherein the inlet valve comprises a synthetic rubber gasket.

20. A volumetric pump according to claim 16, wherein said base includes an inlet and means to connect said pump to a source of fluid to be dispensed by said pump.

21. A volumetric pump according to claim 20, wherein said means to connect said pump comprises a threaded connector.

22. A volumetric pump according to claim 20, wherein said means to connect said pump comprises means to prevent fluids from leaking from said inlet when said pump is disconnected from a source of fluid.

23. A volumetric pump according to claim 1, further comprising means to monitor the number of reciprocal movements of said piston.

24. A volumetric pump according to claim 1, further comprising a vent port in said integral shroud which is in fluid communication with a top portion of said piston.

25. A volumetric pump according to claim 24, further comprising a filter covering said vent port.

26. A volumetric pump according to claim 25, wherein said filter comprises a semipermeable membrane.

27. A volumetric pump according to claim 26, wherein said semipermeable membrane comprises a moisture barrier.

28. A volumetric pump according to claim 1 in combination with an nozzle, said nozzle being connected to an outlet of said pump.

29. A volumetric pump according to claim 28, wherein said nozzle includes an anti-drip spout connected thereto.

30. A volumetric pump according to claim 29, wherein said anti-drip spout includes means for maintaining a prime of the volumetric pump and nozzle, said means for maintaining the prime comprising a spring-biased one-way valve for allowing fluid to pass through said spout when said pump is operated and for preventing fluid from leaking out of said spout when said pump is idle.

31. A volumetric pump according to claim 1, further comprising means for adjustably limiting travel of said piston so that a fixed repeatable volume of fluid is dispensed with each stroke of the piston.

* * * * *